US007568686B2

(12) United States Patent
Terao et al.

(10) Patent No.: US 7,568,686 B2
(45) Date of Patent: Aug. 4, 2009

(54) SHEET PROCESSING APPARATUS

(75) Inventors: Yasunobu Terao, Shizuoka-ken (JP); Hajime Yamamoto, Shizuoka-ken (JP); Yoshiaki Sugizaki, Shizuoka-ken (JP); Takahiro Kawaguchi, Shizuoka-ken (JP); Hiroyuki Taki, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 419 days.

(21) Appl. No.: 11/531,970

(22) Filed: Sep. 14, 2006

(65) Prior Publication Data

US 2007/0063413 A1 Mar. 22, 2007

(30) Foreign Application Priority Data

Sep. 21, 2005 (JP) ..... 2005-274281

(51) Int. Cl.
*B65H 37/04* (2006.01)

(52) U.S. Cl. ..... 270/58.07; 270/58.12; 270/58.17

(58) Field of Classification Search ..... 270/58.07, 270/58.08, 58.12, 58.17
See application file for complete search history.

(56) References Cited

U.S. PATENT DOCUMENTS 5,385,340 A * 1/1995 Hiroi et al. ..... 370/58.13
5,478,062 A * 12/1995 Horiuchi et al. ..... 270/58.08
5,590,871 A * 1/1997 Okabe et al. ..... 270/58.27
7,165,764 B2 * 1/2007 Nakamura et al. ..... 270/58.11
2004/0175217 A1 * 9/2004 Nakamura et al. ..... 399/407

* cited by examiner

*Primary Examiner*—Gene Crawford
*Assistant Examiner*—Leslie A Nicholson, III
(74) *Attorney, Agent, or Firm*—Turocy & Watson, LLP

(57) ABSTRACT

A sheet processing apparatus comprises a processing tray for loading a sheet bundle, a first conveying unit having a rotary shaft which is installed at least at the end on the downstream side in the direction for moving the sheet bundle on the processing tray and is driven to rotate via a first drive source and a drive unit and a roller installed on the rotary shaft for loading and conveying the sheet bundle and discharging the sheet bundle from the end on the downstream side and from the processing tray, and a second conveying unit having a pair of pulleys having at least one of them installed rotatably on the rotary shaft on the downstream side driven to rotate via a second drive source and a drive unit, a belt stretched over the pair of pulleys, and an arm installed on the belt for hooking an end of the sheet bundle on the processing tray, conveying it together with the roller, and discharging the sheet bundle from the end on the downstream side and from the processing tray. The arm of the second conveying unit synchronizes the speed when moving along the straight portion of the belt with the rotational speed of the roller of the first conveying unit and changes the speed when moving in the peripheral direction of the pulley on the downstream side among the pair of pulleys from the rotational speed of the roller.

6 Claims, 8 Drawing Sheets

FIURST DRIVE MOTOR 103

SECOND DRIVE MOTOR 103

ASSIST ARM 50

ELECTROMAGNETIC CLUTCH 91
t1
t2
SPEED
TIME

SHEET PROCESSING APPARATUS

CROSS-REFERENCE TO RELATED APPLICATION

This application is based upon and claims the benefit of priority from the prior Japanese Patent Application No. 2005-274281 filed on Sep. 21, 2005, the entire contents of which are incorporated herein by reference.

BACKGROUND OF THE INVENTION

1. Field of the Invention

The present invention relates to a sheet processing apparatus having a conveying unit for performing a post process such as aligning or binding sheets on a processing tray and discharging an obtained sheet bundle to a paper receiving tray.

2. Description of the Related Art

In U.S. Pat. No. 5,385,340, a sheet post-processing apparatus is described. The apparatus stacks and stores a plurality of sheets with images recorded, which are sent from an image forming apparatus, on a processing tray which is a fixed loading section, staples the rear ends of the sheets, and forms a sheet bundle. Thereafter, the stopper plate strikes the sheet bundle and furthermore, the stopper plate moves and presses out the sheet bundle from the processing tray onto the storing tray. In this apparatus, the stopper plate is positioned firstly at the rear end of the processing tray and aligns the rear ends of sheets sent from the image forming apparatus. When sheets of the selection number are stacked on the processing tray, the stapling unit operates and staples the rear ends of sheets, and the stopper plate starts movement and conveys the sheet bundle.

According to the art described in U.S. Pat. No. 5,385,340, the stopper plate is opposite to almost overall the sheet bundle in the width direction and the sheet bundle moves to the stopper plate, so that the stopper plate itself is made larger, and drive force is required, thus the drive unit is made larger inevitably. Ideally, a belt is stretched between a pair of pulleys, and an arm is installed at a part of the belt and is hooked almost at the central part of a sheet bundle, and the other part of the sheet bundle is just loaded on a roller. When the belt travels, and the arm moves, and the roller is driven to rotate, thus the sheet bundle can be conveyed, the drive force can be reduced and the miniaturization of the drive unit can be promoted. However, even if such a constitution is adopted, unless the moving speed of the arm against the rotational speed of the roller is set under good conditions, the conveyance of the sheet bundle becomes unreasonable and the conveyance reliability is lost.

Generally, the moving speed of the arm moving along the straight portion of the belt is in synchronization with the rotational speed of the roller, so that the movement of the sheet bundle along the sheet placing surface of the processing tray provides no trouble. However, when the arm moves in the peripheral direction of the pulley at the end on the downstream side in the sending direction and reaches a predetermined angle, the sheet bundle can be discharged from the processing tray onto the paper receiving tray, though the speed in the radial direction is increased and in this state, the peripheral speed becomes faster than the moving speed on the straight portion. On the other hand, the rotational speed of the roller is fixed always and the conveyance of the arm and conveyance of the roller are shifted from each other. Therefore, when the arm moves in the peripheral direction of the pulley, the speed against the sheet bundle is increased and the arm cannot synchronize with the roller. After all, the roller breaks, while the arm forcibly presses the sheet bundle and a problem arises that the paper receiving alignment of the sheet bundle lowers.

SUMMARY OF THE INVENTION

The present invention was developed with the foregoing in view and is intended to provide a sheet processing apparatus which has a comparatively simple constitution, can convey and discharge a sheet bundle in a stable status, and improves the conveyance reliability and paper receiving alignment.

To accomplish the above object, the sheet processing apparatus of the present invention comprises a processing tray to load a sheet bundle a first conveying unit having a rotary shaft installed at least at an end on a downstream side in a direction to move the sheet bundle on the processing tray and drive to rotate via a first drive source and a drive unit and a roller installed on the rotary shaft to load and convey the sheet bundle and discharge the sheet bundle from the end on the downstream side and from the processing tray; and a second conveying unit having a pair of pulleys having at least one of them installed rotatably on the rotary shaft on the downstream side driven to rotate via a second drive source and a drive unit, a belt stretched over the pair of pulleys, and an arm installed on the belt to hook an end of the sheet bundle on the processing tray, convey the sheet bundle together with the roller, and discharge the sheet bundle from the end on the downstream side and from the processing tray, wherein the arm of the second conveying unit synchronizes the speed when moving along a straight portion of the belt with a rotational speed of the roller of the first conveying unit and changes the speed when moving in a peripheral direction of the pulley on the downstream side among the pair of pulleys from the rotational speed of the roller.

DETAILED DESCRIPTION OF THE EMBODIMENTS

Figure 1:
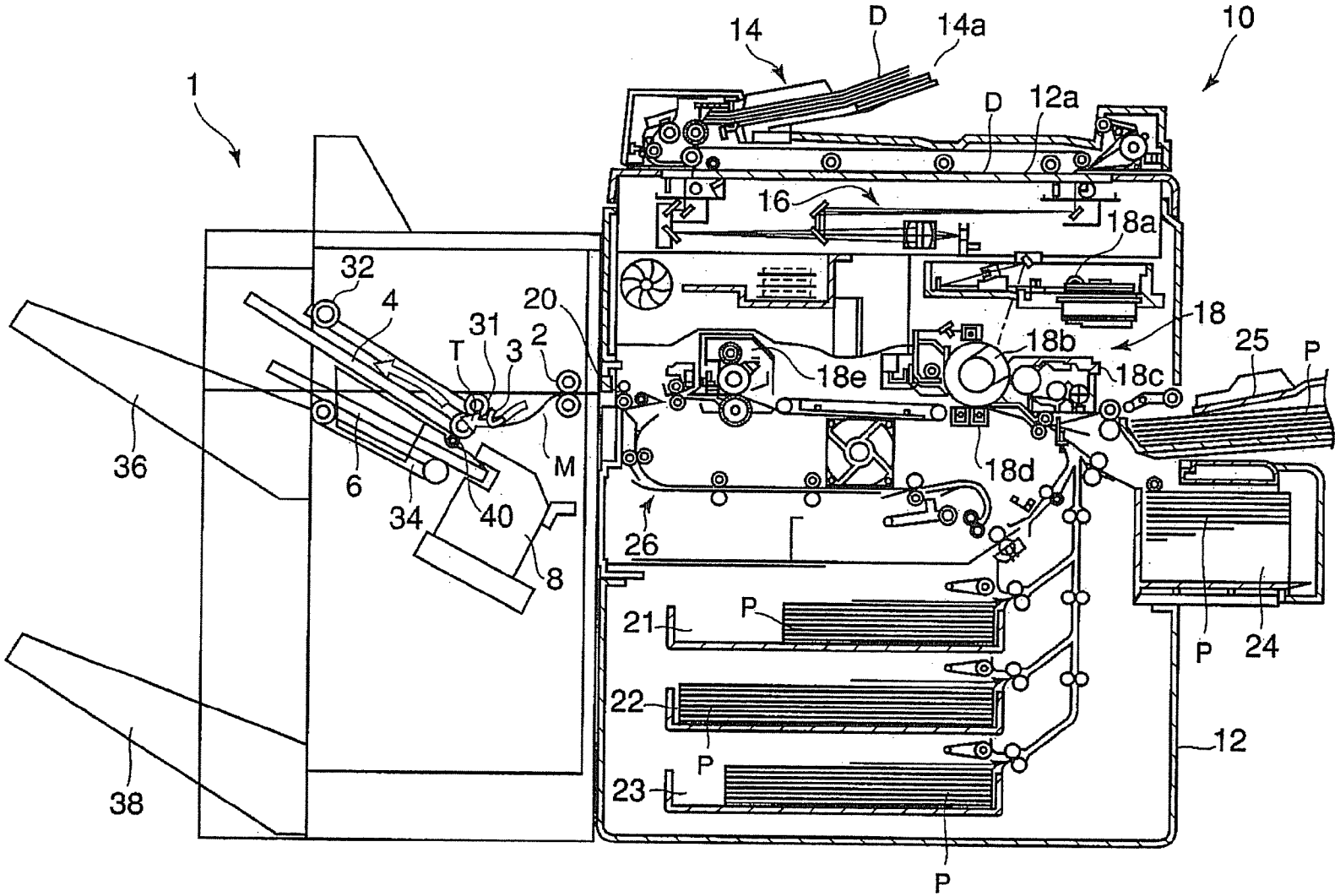
FIG. 1 is a schematic block diagram showing the copying machine having a sheet post-processing apparatus relating to an embodiment of the present invention.

Hereinafter, the embodiments of the present invention will be explained in detail with reference to the accompanying drawings. FIG. 1 is a schematic diagram of sheet post-processing apparatus 1 functioning as a sheet processing apparatus relating to an embodiment of the present invention and copying machine 10 which is an image forming apparatus to which sheet post-processing apparatus 1 is connected. Copying machine 10 has housing 12 which is a shell of the apparatus and on the top of housing 12, document table 12*a* composed of a transparent glass plate is installed. Above document table 12*a*, automatic document feeder 14 (hereinafter, referred to as just ADF 14) is installed openably. ADF 14 operates so as to automatically send document D to a predetermined position on document table 12*a*.

For example, documents D are set on paper supply tray 14*a* of ADF 14 and existence of the stapling process, how to perform the stapling process, the number of copies, and paper size are set by the control panel. When the copy start switch is pressed after the setting, documents D on paper supply tray 14*a* are automatically supplied one by one to the document reading position on document table 12*a* and after the documents are read, are automatically discharged at appropriate timing. Inside housing 12, scanner unit 16, printer unit 18, and cassettes 21, 22, and 23 for storing papers P with different sizes are arranged. On the right wall of housing 12 in the drawing, large volume paper feeder 24 storing a large amount of papers with the same size and manual paper feed tray 25 are attached. Furthermore, to the left wall of housing 12 in the drawing, sheet post-processing apparatus 1 which will be described later is connected.

Scanner unit 16 lights up and scans documents D supplied to the document reading position on document table 12*a* by ADF 14, reads and converts photo-electrically the reflected light, and obtains image information of documents D. Printer unit 18 energizes laser exposing device 18*a* on the basis of the image information read by scanner unit 16 and forms an electrostatic latent image based on the image information on the peripheral surface of photo-conductive drum 18*b*. And, printer unit 18 supplies and visualizes toner to the electrostatic latent image on photo-conductive drum 18*b* via developing device 18*c* and transfers the toner image onto paper P by transfer charger 18*d*.

At this time, paper P is supplied from any of cassettes 21, 22, and 23, large volume paper feeder 24, and manual paper feed tray 25. Furthermore, printer unit 18 supplies paper P to which the toner image is transferred to fixing device 18*e*, heats and melts the toner image, fixes it on paper P, and discharges it to sheet post-processing apparatus 1 via discharging port 20. Paper P discharged via discharging port 20 conforms to sheet M explained in the embodiment of the present invention. Further, after passing fixing device 18*e*, paper P requiring duplex copy is conveyed to converting path 26, is turned upside down, and is sent again into the fixing area between photo-conductive drum 18*b* and fixing device 18*e*.

On the other hand, sheet post-processing apparatus 1 stacks and aligns image-formed papers, that is, sheets M discharged via discharging port 20 of copying machine 10 in a unit of the designated number of sheets merged and bound and performs the stapling process which is a post process. The stapling process is referred to as a process of aligning and binding one ends of a plurality of sheets M stacked. Sheet post-processing apparatus 1 has entrance roller 2 and entrance sensor 3 at the position opposite to discharging port 20 of copying machine 10. Entrance sensor 3 detects passing of the front end and rear end of sheet M sent to sheet post-processing apparatus 1 via entrance roller 2 in the sending direction indicated arrow T in the drawing.

Sheet post-processing apparatus 1 includes queuing tray 4 for stacking sheets M of the number sent in the direction of arrow T via entrance roller 2 to stand by, processing tray 6 for receiving sheets M dropped from queuing tray 4 and aligning the rear ends thereof for the stapling process, and stapler 8 which is a sheet post-processing unit for stapling the rear ends of sheets M stacked and aligned by processing tray 6. Queuing tray 4 and processing tray 6 are installed so as to be inclined upward in the sending direction of sheets M. In other words, queuing tray 4 and processing tray 6 are inclined downward toward the rear ends of sheets M. The stapling process by stapler 8 requires a fixed period of processing time, so that during the stapling process of sheets M on processing tray 6, it is necessary to make sheets M in unit of the designated number of sheets to be bound next stand by at another location.

In this embodiment, during the stapling process for preceding sheets M in unit of the designated number, among sheets M to be processed next, two sheets M stand by on queuing tray 4, thus the period of time for stapling preceding sheets M in unit of the designated number is ensured. Namely, first sheet M and second sheet M which are sent in the direction of arrow T are stacked on queuing tray 4 to stand by. And, after end of the stapling process in unit of the preceding designated number of sheets, two sheets M standing by on queuing tray 4 are dropped onto processing tray 6. Third and subsequent sheets M all pass queuing tray 4 and are stacked directly on processing tray 6.

Figure 2:
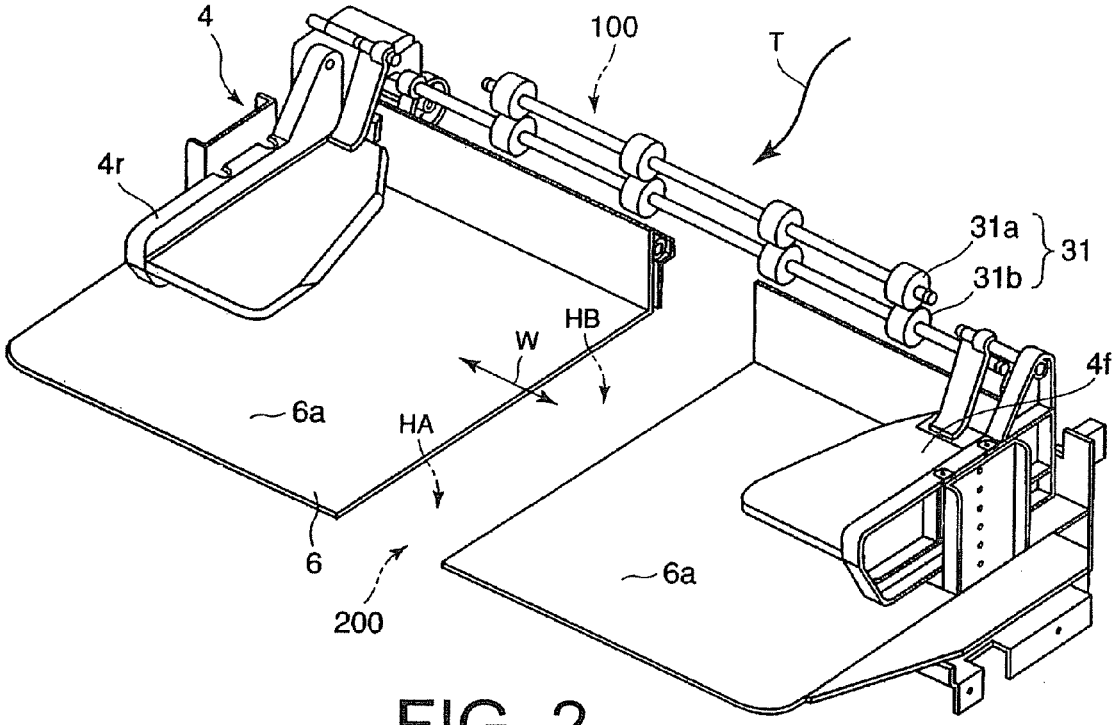
FIG. 2 is a schematic perspective view of the queuing tray and processing tray relating to the same embodiment.

FIG. 2 is a drawing schematically showing queuing tray 4 and processing tray 6. Queuing tray 4 has two open/close trays 4*r* and 4*f* for opening and closing in the direction (the direction of arrow w in the drawing) (hereinafter, this direction is referred to as "width direction W") crossing sending direction T of sheets M. Open/close trays 4*r* and 4*f*, for example, are connected to a motor via a rack pinion unit not drawn and perform an open/close operation synchronously with each other between the support position for supporting the neighborhood of the rear end corner of sheet M sent in sending direction T in the sending direction and the release position for releasing the support. When open/close trays 4*r* and 4*f* are opened to the release position, sheets M stacked are dropped onto processing tray 6. At this time, the width of the opening formed between two open/close trays 4*r* and 4*f* is widened toward the upstream side in the sending direction. Therefore, when open/close trays 4*r* and 4*f* are opened, the rear ends of sheets M stacked in the sending direction are dropped firstly onto processing tray 6.

And, both queuing tray 4 and processing tray 6 are inclined downward toward the rear side, so that when sheets M are dropped from queuing tray 4 onto processing tray 6, sheets M are pressed so as to slightly move on the rear end side. On the upstream side of queuing tray 4 in the sending direction, as shown also in FIG. 1, paper feed roller 31 for clamping sheets M sent in sending direction T indicated by the arrow and feeding them to queuing tray 4 is installed. Paper feed roller 31 has a plurality of upper roller 31*a* and lower roller 31*b* facing each other. Paper feed roller 31 is controlled so as to start rotation using the detection of passing of the front end of sheet M in sending direction T by entrance sensor 3 as a trigger and stop the rotation using the detection of passing of the rear end of concerned sheet M in sending direction T by entrance sensor 3 as a trigger.

On the downstream side of queuing tray 4 in sending direction T, queuing tray roller 32 is installed (shown only in FIG.

1 and omitted in FIG. 2). Queuing tray roller 32 is separably arranged opposite to the sheet placing surface of queuing tray 4 and can rotate forward and backward. Namely, sheets M sent to queuing tray 4 are rotated backward to convey slightly in the opposite direction of sending direction T and reposition and sheets M requiring no stapling process are stacked on queuing tray 4 and then are rotated forward to discharge toward paper receiving tray 36 or 38. Paper receiving trays 36 and 38 can move vertically in accordance with a processed object.

Figure 3:
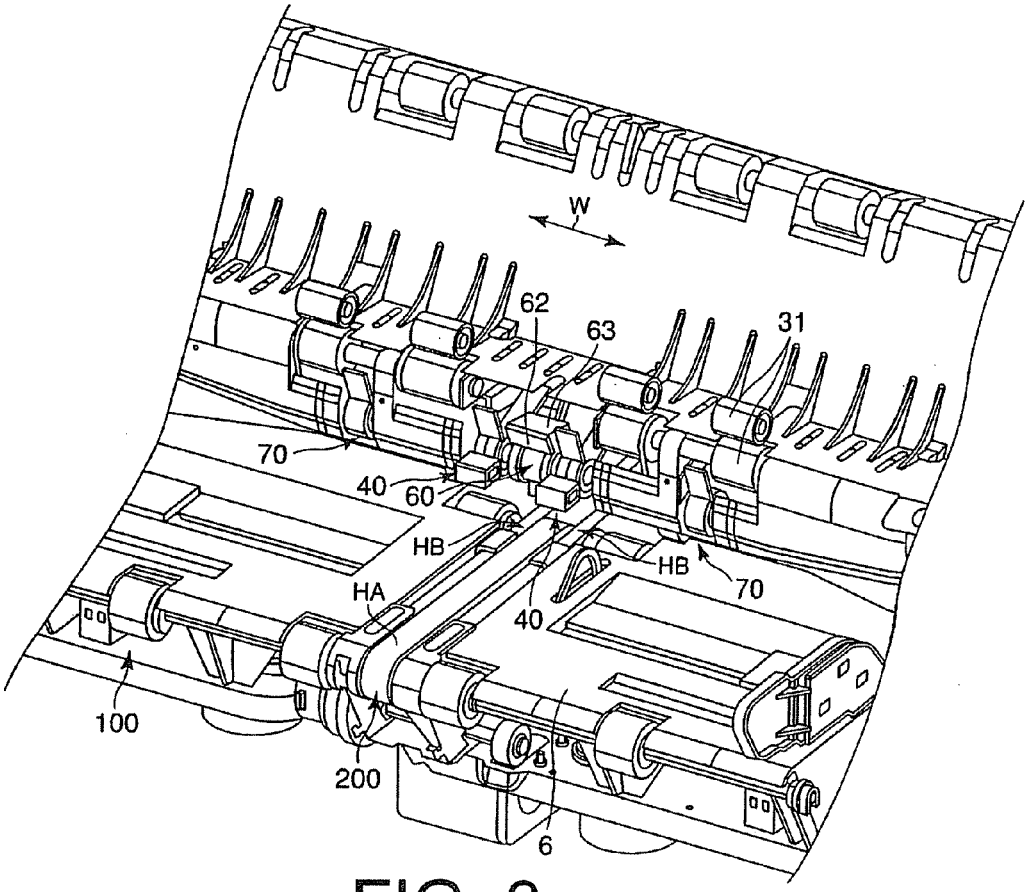
FIG. 3 is a perspective view of a part of the essential section relating to the same embodiment.

Processing tray 6 has flat sheet placing surface 6*a* for loading and stacking sheets M dropped from queuing tray 4. The central part of processing tray 6 in width direction W, as described later, has first conveying unit 100 and second conveying unit 200 (both are not drawn in FIG. 2) for conveying sheets M post processed toward paper receiving tray 36 or 38. Particularly, second conveying unit 200 is composed of main conveying unit HA and auxiliary conveying unit HB and to expose the conveying surfaces of sheets M of the conveying units from sheet placing surface 6*a*, processing tray 6 is divided horizontally into two parts except the central part. FIG. 3 is a perspective view of sending member 40, pressing member 60, and auxiliary sending member 70 composing sheet post-processing apparatus 1 and main conveying unit HA and auxiliary conveying unit HB composing the second conveying unit (for a part of the components, the numerals are omitted or not drawn). Firstly, sending member 40, pressing member 60, and auxiliary sending member 70 will be explained schematically. Extending in width direction W at the position neighboring with paper feed roller 31, the rotary shaft is supported flexibly and pressing member 60 is installed at the central part thereof. Furthermore, a pair of sending members 40 are installed horizontally on both sides of pressing member 60, and auxiliary sending members 70 are installed outside respective sending members 40.

Pressing member 60 includes a flexibly supporting portion rotatably supported by the rotary shaft, a pressing portion projected from a part of the peripheral surface of the flexibly supporting portion with a rubber material adhered overall, and a guide portion folded and formed integrally with the front edge of the pressing portion having a curved section, while pressing portion 62 has a flat section. In the neighboring portion of pressing member 60, an electromagnetic solenoid is arranged and a connection unit is installed between the electromagnetic solenoid and pressing member 60. According to the control for the electromagnetic solenoid, pressing member 60 is energized to rotate via the connection unit. Sending member 40 includes a receiver for receiving the rear ends of sheets M sent to queuing tray 4 in sending direction T, a slapping portion for slapping downward the rear ends of sheets M received by the receiver, a paddle for scraping and sending sheets M dropped on processing tray 6 on the upstream side which is downward, and a rotor to which the rear ends of the receiver, slapping portion, and paddle are integrally attached and which is fit into the rotary shaft.

Figure 4A:
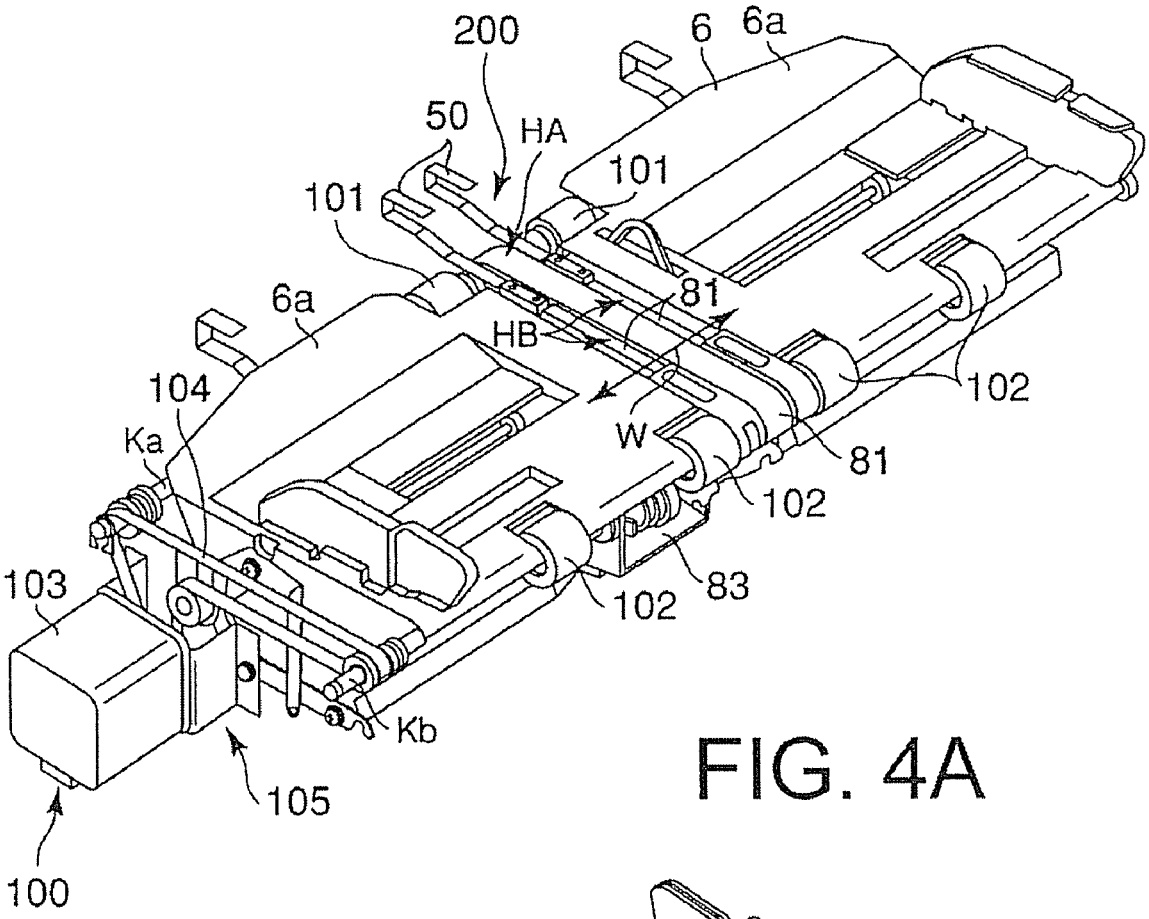
FIGS. 4A and 4B are perspective views for explaining the processing tray, first conveying unit, and second conveying unit relating to the same embodiment and showing different conditions.
Figure 4B:
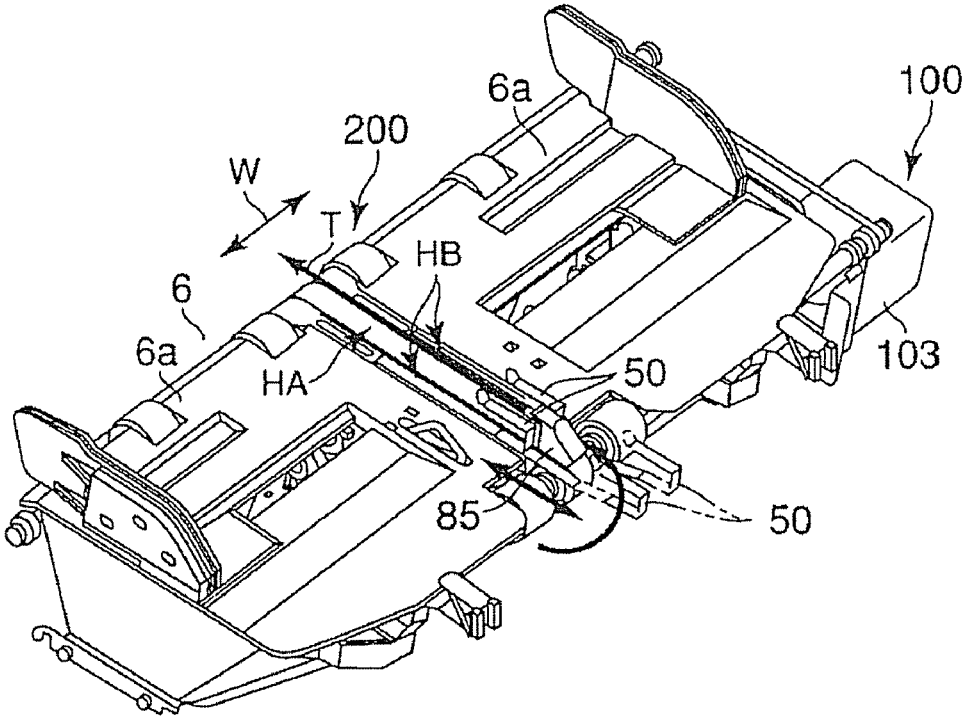
Figure 5:
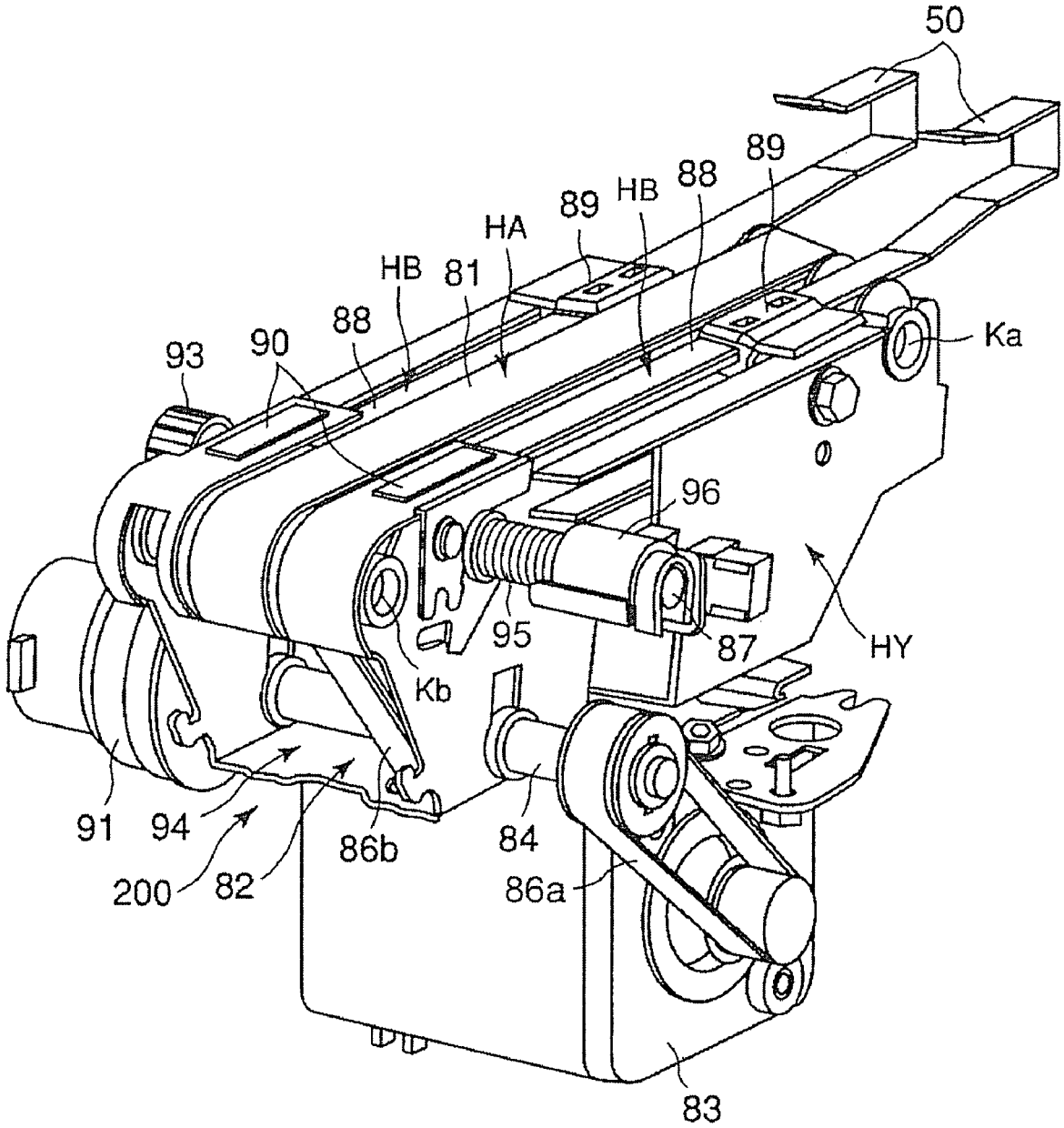
FIG. 5 is a perspective view of the second conveying unit relating to the same embodiment.
Figure 6A:
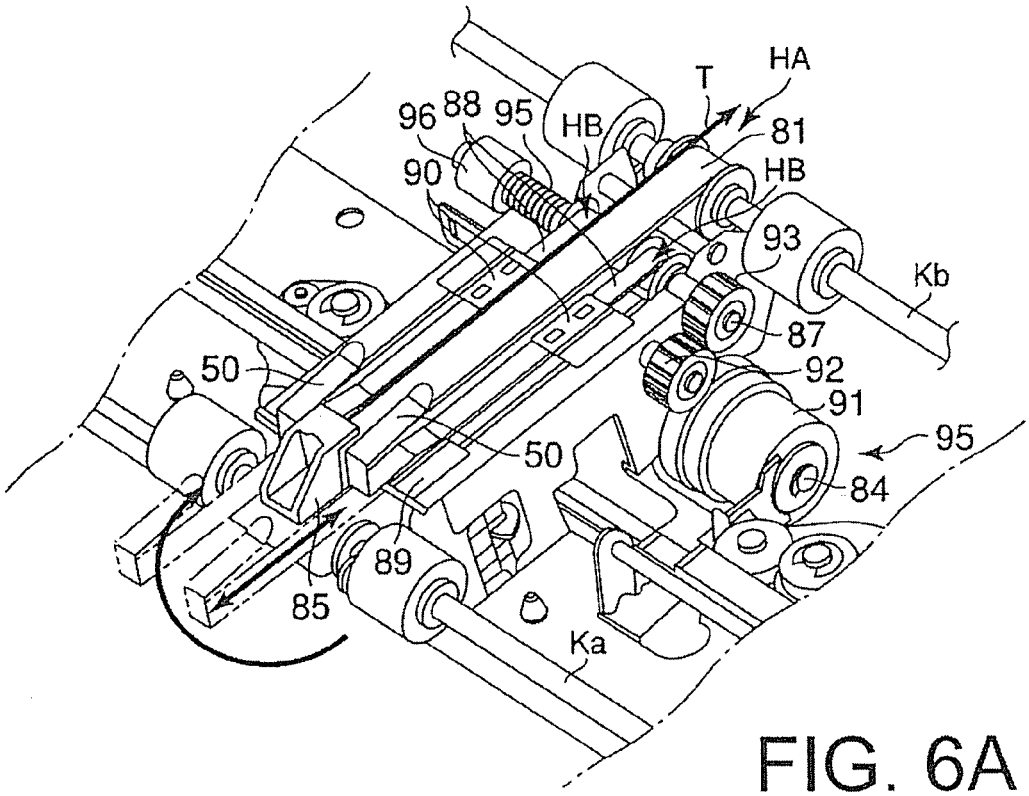
FIGS. 6A and 6B are perspective views of the first conveying unit and second conveying unit when the processing tray is removed relating to the same embodiment.
Figure 6B:
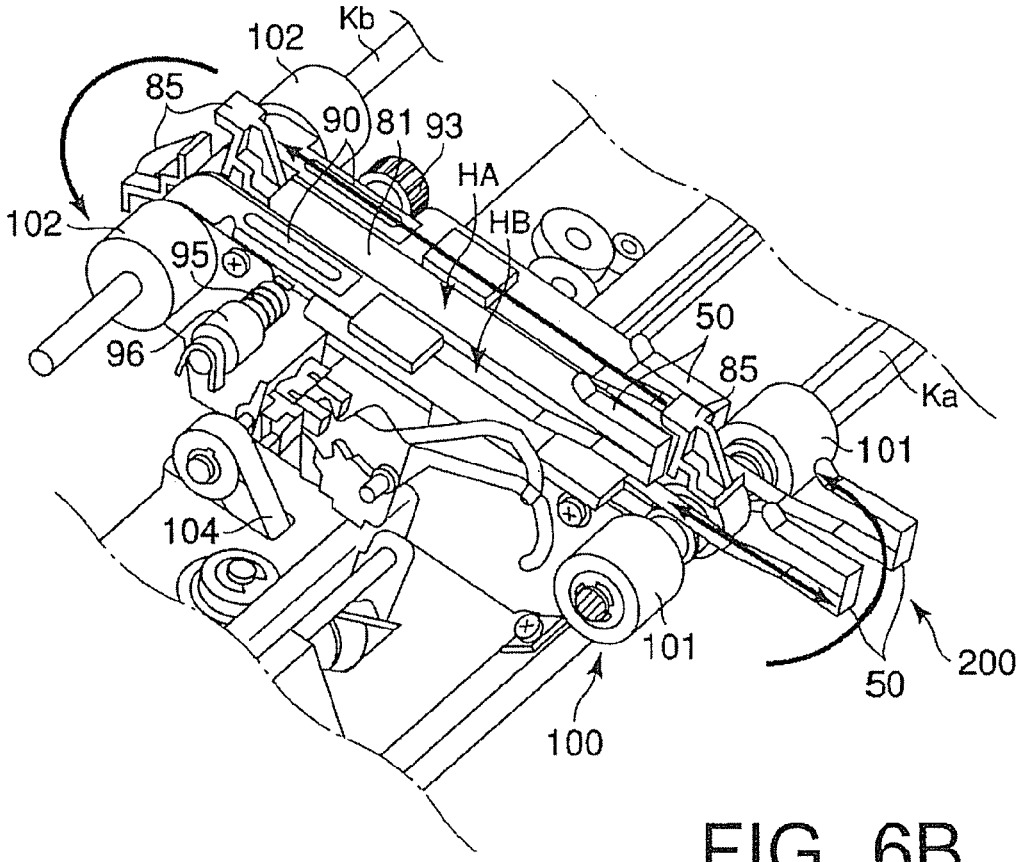
Figure 7:
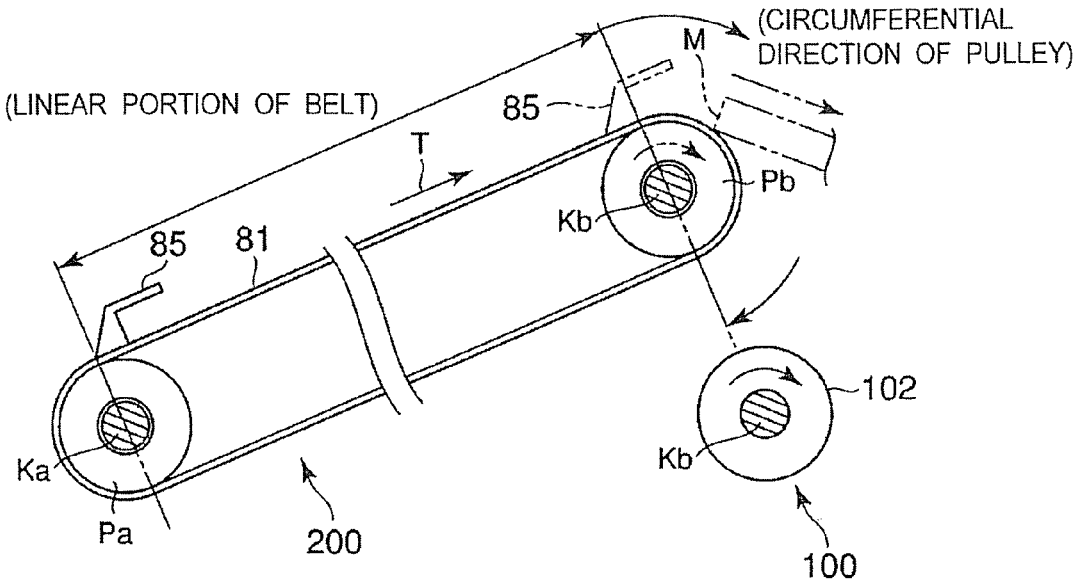
FIG. 7 is a schematic view for explaining the conveying speed control for the arm and roller relating to the same embodiment.

Auxiliary sending member 70 is composed of the rotor fit and fixed to the rotary shaft and an auxiliary slapping portion installed on the rotor. The position of the auxiliary slapping portion for the rotary shaft of auxiliary sending member 70 and the position of the slapping portion for the rotary shaft of sending member 40 are set at the same angle. Next, main conveying unit HA and auxiliary conveying unit HB will be described in detail. FIGS. 4A and 4B are perspective views of processing tray 6, first conveying unit 100, and second conveying unit 200, which are in different conditions in different fields of view. FIG. 5 is a perspective view of unit structure HY having main conveying unit HA and auxiliary conveying unit HB and FIG. 6 is a perspective view of first conveying unit 100 and second conveying unit 200 when processing tray 6 is removed, which are drawn in different fields of view. FIG. 7 is a drawing for explaining the speed control for arm 85 and controller 102.

First conveying unit 100 will be explained first. At the upstream side end and downstream side end of processing tray 6 in sending direction T, rotary shafts Ka and Kb are installed almost extending in the width direction. On rotary shaft Ka on the upstream side, two conveying rollers 101 are fit and fixed on both sides of second conveying unit 200 and on rotary shaft Kb on the downstream side, four conveying rollers 102 in total are fit and fixed on both sides of second conveying unit 200 and on the sides at a predetermined interval (FIG. 4A). Conveying rollers 101 and 102 have diameters designed so that a part thereof is slightly projected from sheet placing surface 6*a* of processing tray 6.

On one side of processing tray 6 in width direction W, first drive motor 103 (FIG. 4A) which is a first drive source is attached and fixed. To the rotary shaft of first drive motor 103 and on one sides of rotary shafts Ka and Kb, a pulley is fit and fixed and on the side of processing tray 6, an idle pulley is installed. Drive belt 104 is stretched between these pulleys and drive unit 105 of first conveying unit 100 is formed.

Next, main conveying unit HA of second conveying unit 200 will be explained. At the central parts of rotary shafts Ka and Kb, pulleys Pa and Pb (shown only in FIG. 7) are fit rotatably and belt 81 is stretched between pulleys Pa and Pb. Pulley Pb fit rotatably into rotary shaft Kb on the downstream side is connected to second drive motor 83, which is a second drive source, via second drive unit 82 which will be described later. Belt 81 is exposed on sheet placing surface 6*a* of processing tray 6 and can move endlessly along facing surface 6*a*. Particularly, as shown in FIGS. 4B, 6A, and 6B, on a part of belt 81, main arm 85 with the same width as that of belt 81 is installed integrally. In main arm 85, when it is projected from sheet placing surface 6*a* of processing tray 6, so as to be opened toward the downstream side in sending direction T, the section is formed almost in a U shape. Further, on the lower side of belt 81, there are no obstacles caused to moving of main arm 85.

Particularly as shown in FIG. 5, main conveying unit HA and auxiliary conveying unit 1B composing second conveying unit 200 are unified and to the bottom of unit structure HY, second drive motor 83 is attached. A pulley is fit into the rotary shaft of second drive motor 83 and between it and a pulley installed on spindles 84, drive belt 86*a* is stretched. Spindles 84 are installed in parallel with rotary shaft Kb on the downstream side and also inside unit structure HY of spindles 84, a pulley is fit. A pulley is installed on rotary shaft Kb on the downstream side and between it and the pulley of spindles 84, driven belt 86*b* is stretched. In this way, second drive unit 82 is structured and the rotary drive force of second drive motor 83 is transferred to belt 81 stretched in parallel with sheet placing surface 6*a* of processing tray 6 via second drive unit 82 having two steps of belts 86*a* and 86*b*.

Auxiliary conveying unit HB has pulleys on both sides of the pulley of main conveying unit HA attached to rotary shaft Ka on the upstream side and has a pulley in spindle 87, which will be described later, installed in the neighborhood of rotary shaft Kb on the downstream side. Between these pulleys, belt 88 which is exposed on sheet placing surface 6*a* of processing tray 6 and moves endlessly along facing surface 6*a* is stretched. On a part of belt 88, assist arm 50 with the same width as that of belt 88 is installed via attachment tool 89. Assist arm 50 is a piece formed in almost the same width as that of belt 88 and is folded and formed almost in a U shape so as to be opened toward the downstream side in the sending direction.

Assist arm 50 ahead attachment tool 89 is formed almost linearly and belt 88 is extended straight. Therefore, with respect to sheets M led to processing tray 6, the rear ends thereof are hooked by assist arm 50 and a part thereof is projected on the side of processing tray 6. Assist arm 50 is aligned at the same position as that of stapler 8.

For belt 88 of auxiliary conveying unit HB, in the neighborhood of rotary shaft Kb on the downstream side in sending direction T, stopper 90 is installed across the top of belt 88. When belt 88 travels and assist arm 50 moves from the home positions, stopper 90 collides with attachment tool 89 of assist arm 50, thus the additional movement of assist arm 50 and belt 88 is controlled. On the other hand, at the end of spindle 84 into which both pulleys of drive belt 86*a* and driven belt 86*b* are fit, electromagnetic clutch 91 is installed. Drive gear 92 flexibly supported by unit structure HY meshes with the output portion of electromagnetic clutch 91 and drive gear 92 meshes with driven gear 93 installed on spindle 87 of auxiliary conveying unit HB.

Drive unit 94 of auxiliary conveying unit HB is structured in this way, and the drive force of drive motor 83 is transferred to electromagnetic clutch 91 from drive belt 86*a* and to spindle 87 via gears 92 and 93, and a pair of belts 88 are driven to travel at the same time.

Further, a part of spindle 87 on the downstream side is projected from unit structure HY and round the projection, torsion coil spring 95 which is an elastic body is wound and a part of torsion coil spring 95 is covered with holding member 96.

One end of torsion coil spring 95 is hooked by a hole formed in unit structure HY and the other end is hooked by holding member 96. Holding member 96 has a circular section, has an inside diameter formed larger than the outside diameter of torsion coil spring 95, thereby covers a part of or the greater part of torsion coil spring 95.

Next, the operation of sheet post-processing apparatus 1 will be explained. First sheet M is sent to sheet post-processing apparatus 1 from copying machine 10 and sheet M is fed toward queuing tray 4. At this time, pressing member 60 does not interrupt sheet M to be fed. Both sides of sheet M in the transverse direction are put on queuing tray 4 and the rear end of sheet M is put on receivers. Queuing tray 4 and the receiver are inclined upward in the sending direction and sheet M is pressed so as to move on the rear end side by its own weight. The width of the opening between open/close trays 4*r* and 4*f* composing queuing tray 4 is widened toward the rear end of sheet M, so that the central part of the rear end hangs down by its own weight and this part is received by the receiver.

Pressing member 60 rotates in exact timing, and the pressing portion is put on the top of the rear end of sheet M and clamps the rear end of sheet M in cooperation with the receiver. Thereafter, second sheet M is sent to queuing tray 4 across pressing member 60 and is stacked on first sheet M. The rear end of first sheet M is clamped, so that even if the front end of second sheet M collides with first sheet M or even if it slides and moves on first sheet M, the posture of first sheet M is not broken and second sheet M is stacked normally.

When second sheet M is put on first sheet M, the rear end of second sheet M makes contact with the front end of the guide portion. Therefore, second sheet M is supported in the state that it is shifted from first sheet M on the downstream side in the sending direction, thus it is shifted forward from the rear end of first sheet M. Next, open/close trays 4*r* and 4*f* composing queuing tray 4 are moved and opened outside in the transverse direction and sending member 40 is driven to rotate. The receiver separates from the rear end of first sheet M and releases the support and the slapping portion rotates and slaps the rear end of second sheet M. Simultaneously, auxiliary sending member 70 operates and auxiliary slapping portion slaps the rear ends of two sheets M. Both sheets M are dropped onto processing tray 6. There is nothing under the pressing portion for pressing first sheet M, so that when the support by the receiver is eliminated, the rear end of sheet M becomes free perfectly. The rear end of second sheet M is positioned forward the pressing portion, so that the pressing portion does not interrupt it and two sheets M are put smoothly on processing tray 6.

Furthermore, sending member 40 continues rotation and the slapping portion separates from sheets M, while the paddle makes contact with upper sheet M. The paddle is made of an elastic material and makes contact with second sheet M, is deformed elastically, and scrapes and sends second sheet M toward first arm 50 by the frictional force, that is, in the rotational direction. The rear end of second sheet M is shifted and stacked forward from the rear end of first sheet M, and the scraping and sending force of the paddle mainly acts on second sheet M, so that by restoring the shift from first sheet M, the rear ends of two sheets M can be aligned perfectly with assist arm 50.

Figure 8:
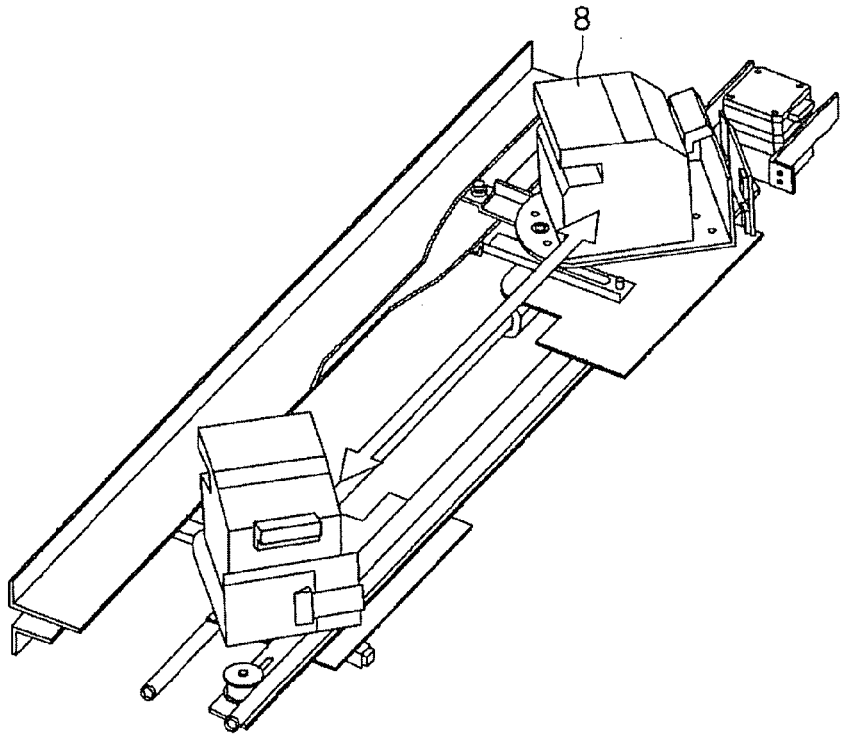
FIG. 8 is a perspective view for explaining the operation of the stapler relating to the same embodiment.

Open/close trays 4*r* and 4*f* composing queuing tray 4 are kept in the open state and third and subsequent sheets M of the designated number are directly sent to processing tray 6 and are sequentially put on two sheets M with the rear ends aligned. Immediately after sheets M are put on processing tray 6, in exact timing, the paddle scrapes and sends them toward assist arm 50. Processing tray 6 itself is inclined upward in the sending direction, so that the rear ends of all the sheets are aligned. When designated sheets M are all put on processing tray 6 with the rear ends aligned in this way, as shown in FIG. 8, stapler 8 installed so as to move along the rear ends of sheets M moves to a predetermined stapling position and binds sheets M. At this time, so as to prevent first arm from colliding with stapler 8, the shape, structure, and mounting position of first arm 50 are taken into account.

While sheets M are stacked on processing tray 6 and the post process of binding the rear ends thereof is performed, not only first drive motor but also second drive motor 83 are stopped. Main arm 85 of main conveying unit HA is positioned on the lower side of belt 81 and is not exposed on sheet placing surface 6*a* of processing tray 6. Therefore, even if two sheets M are dropped from queuing tray 4 onto processing tray 6 and even if third and subsequent sheets M are directly led to processing tray 6, main arm 85 causes no obstacles to sheets M.

Figure 9A:
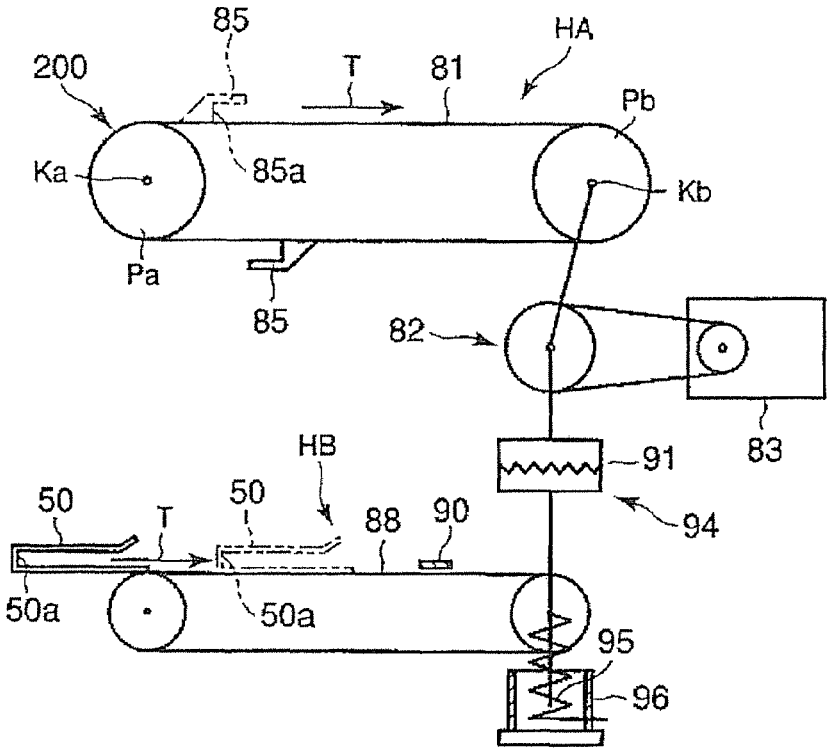
FIGS. 9A and 9B are schematic views for explaining sequentially the operations of the second conveying unit relating to the same embodiment.
Figure 9B:
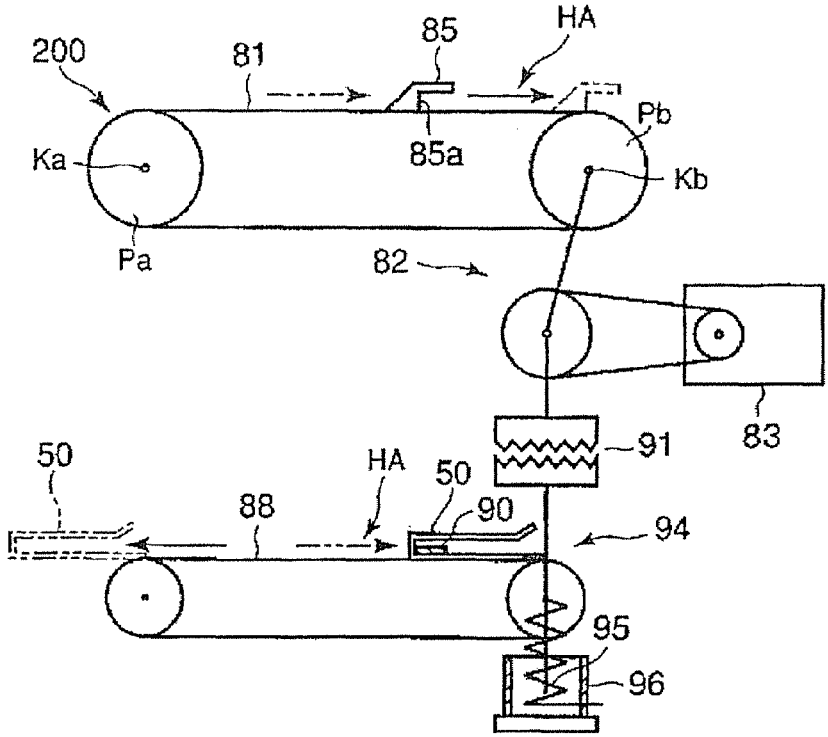

FIGS. 9A and 9B are drawings schematically showing the operations of main conveying unit HA and auxiliary conveying unit HB composing second conveying unit 200. Actually, the units are inclined upward in sending direction T, though here, they are shown horizontally. Further, sheets M and processing tray 6 are not drawn. As shown in FIG. 9A, upon receipt of a signal indicating end of the post process for sheets M, drive motor 83 is driven, and the drive force is transferred to belt 81 via drive unit 82 of main conveying unit HA, and belt 81 starts travel in sending direction T of the arrow shown in the drawing. In auxiliary conveying unit HB, electromagnetic clutch 91 is in the connection state, and the drive force of drive motor 83 is transferred via drive unit 94, and the pair of belts 88 simultaneously start travel in sending direction T of the arrow shown in the drawing. At this time, first drive motor 103 is also driven and drives to rotate rotary shaft Ka on the upstream side and rotary shaft Kb on the downstream side simultaneously in the same direction via first drive unit 105.

Sheet bundle M stacked on processing tray 6 is on conveying roller 101 fit and fixed to rotary shaft Ka on the upstream side and on belts 81 and 88 composing main conveying unit HA and auxiliary conveying unit HB and furthermore, are hooked by a pair of assist arms 50. Actually, the rear end of sheet bundle M is hooked by assist arm 50, and the other part is put on attachment tool 89 for attaching conveying roller 101 and assist arm 50 to belt 81, and there exists a narrow gap between it and the main surfaces of belts 81 and 88 of main conveying unit HA and auxiliary conveying unit HB. Sheet bundle M is conveyed by conveying roller 101 and assist arm 50 and is independent of travel of belt 81 of main conveying unit HA. Simultaneously, in main conveying unit HA, main arm 85 performs position movement of moving from the lower side of belt 81 to the upper side thereof.

Together with processing tray 6, belts 81 and 88 of main conveying unit HA and auxiliary conveying unit HB are inclined upward in sending direction T, though sheet bundle M is conveyed in the state that the rear end thereof is hooked by assist arm 50, so that sheet bundle M will not slide down in the opposite direction of sending direction T. When sheet bundle M is separated from conveying roller 101 of rotary shaft Ka on the upstream side and assist arm 50 moves and reaches the predetermined position indicated by the two-dot chain line in the drawing, main arm 85 also reaches the same predetermined position indicated by the two-dot chain line in the drawing. The condition that the positions of main arm 85 and assist arm 50 are aligned in this way is shown in FIGS. 4B and 6.

Simultaneously, in correspondence to the rotation of spindle 87 of auxiliary conveying unit HB, holding member 96 for hooking one end of torsion coil spring 95 rotates and the other end of torsion coil spring 95 is hooked by unit structure HY, so that the position is not changed. In torsion coil spring 95, the diameter is controlled so as to be sequentially made smaller, thus the elastic force is accumulated. As shown in FIG. 9B, when first arm 50 moves, it is stopped by stopper 90 installed across belt 88. Actually, attachment tool 89 for attaching the base end of assist arm 50 to belt 88 collides with stopper 90. Upon receipt of a signal of this collision, it is sent to electromagnetic clutch 91 and the clutch enters the disconnection state and belt 88 of auxiliary conveying unit HB stops movement.

On the other hand, belt 81 of main conveying unit HA continuously drives drive motor 83 and travels at it is. Sheet bundle M is kept hooked by main arm 85 and is put and conveyed continuously on conveying roller 101 attached to rotary shaft Kb on the downstream side. Finally, main arm 85 reaches the end of processing tray 6 on the downstream side in sending direction T and moves in the peripheral direction of pulley Pb on the downstream side on which belt 81 is stretched. When main arm 85 moves to a predetermined angle of pulley Pb on the downstream side, it discharges sheet bundle M under conveyance to paper receiving tray 36 or 38. Further, this paper discharging status will be described later. On the other hand, in auxiliary conveying unit HB, electromagnetic clutch 91 enters the disconnection state, thus the rotational drive force to spindle 87 is removed (at time t1 shown in FIG. 10D). Therefore, torsion coil spring 95 wound round spindle 87 to suppress the diameter thereof discharges the accumulated elastic force at a stretch. Spindle 87 is inversely driven rapidly by the operation of torsion coil spring 95, and belt 88 is driven to travel at a rapid speed in the opposite direction of the preceding traveling direction, and assist arm 50 is returned to the home position at a rapid speed (at time t1 shown in FIG. 10C).

At least one part of torsion coil spring 95 is covered with cylindrical holding member 96. Therefore, not only when the diameter of torsion coil spring 95 is suppressed in correspondence to the rotation of spindle 87 but also when the accumulated elastic force is discharged at a stretch and the diameter is enlarged, holding member 96 holds the external form of torsion coil spring 95. Namely, at least one part of torsion coil spring 95 is covered with cylindrical holding member 96, thus vibration is prevented and the load can be stabilized. By the operation of torsion coil spring 95, assist arm 50 passes the predetermined position aligned before with the position of main arm 85 and returns rapidly toward it original home position. Attachment tool 89 of assist arm 50 collides with a stopper not drawn and stops and belt 81 stops the movement. While only main arm 85 conveys sheet bundle M and discharges it to paper receiving tray 36 or 38, by the operation of the elastic recovery force of torsion coil spring 95, the pair of assist arms 50 can be returned almost instantaneously to the home position shown in FIG. 9A.

Before main arm 85 of main conveying unit HA returns again to the home position shown in FIG. 9A, drive motor 83 operates continuously and during the period, electromagnetic clutch 91 continues the disconnection state. Therefore, on sheet placing surface 6*a* of processing tray 6, main arm 85 does not exist and assist arm 50 is at the standby position, so that sheets M to be post-processed next can be stacked on processing tray 6. FIG. 7 is a drawing for explaining the comparison of the speed control for belt 81 to which main arm is attached with rotary speed of conveying roller 102 on the downstream side attached to rotary shaft Kb on the downstream side. Namely, when conveying sheet bundle M along sheet placing surface 6*a* of processing tray 6, main arm 85 moves along the straight portion of belt 81. A part of sheet bundle M is loaded on conveying roller 101 attached to rotary shaft Ka on the upstream side and is conveyed also by conveying roller 101 on the upstream side.

Further, sheet bundle M is not put on conveying roller 102 attached to rotary shaft Ka on the downstream side, though conveying roller 102 on the downstream side is also connected to drive unit 105 similarly to conveying roller 101 on the upstream side, so that both conveying rollers rotate at the same rotational speed. Therefore, while main arm 85 moves along the straight portion of belt 81, the moving speed of main arm 85 is synchronized with the rotational speed of conveying rollers 101 and 102 on the upstream and downstream sides. Before main arm 85 moves sheet bundle M up to the end on the downstream side in sending direction T, that is, the final end of the straight portion of belt 81, sheet bundle M is loaded on conveying roller 102 on the downstream side and is conveyed by conveying roller 102 on the downstream side together with main arm 85. And, main arm 85 moves in the peripheral direction of pulley Pb on the downstream side and when it reaches the predetermined angle, can discharge sheet bundle M from processing tray 6 to paper receiving tray 36 or 38. When main arm 85 moves in the peripheral direction of pulley Pb on the downstream side, the speed in the radial direction increases and the peripheral speed becomes faster than the moving speed on the straight portion.

Therefore, as mentioned above, the speed when main arm 85 moves along the straight portion of belt 81 synchronizes with the rotational speed of conveying roller 102 and the speed when main arm 85 moves in the peripheral direction of pulley Pb is set so as to change from the rotational speed of conveying roller 102. Concretely, the speed when main arm 85 moves in the peripheral direction of pulley Pb is set so as to be slower than the rotational speed of conveying roller 102. By doing this, when main arm 85 moves on the straight portion of belt 81, the moving speed of belt 81 is made fit to the rotational speed of conveying roller 102, so that no shift is caused between the conveyance of main arm 85 and the conveyance of conveying roller 102 and both convey smoothly and surely. And, when main arm 85 moves from the straight portion of belt 81 in the peripheral direction of pulley Pb on the downstream side, the speed against sheet bundle M is set slower than the rotational speed of conveying roller 102, so that the moving speed of main arm 85 synchronizes with the rotational speed of conveying roller 102, thus conveying roller 102 will not become uneven resistance. Main arm 85 can press out and discharge smoothly sheet bundle M and improves the paper receiving alignment for sheet bundle M.

Figures 10A, 10B, 10C, 10D:
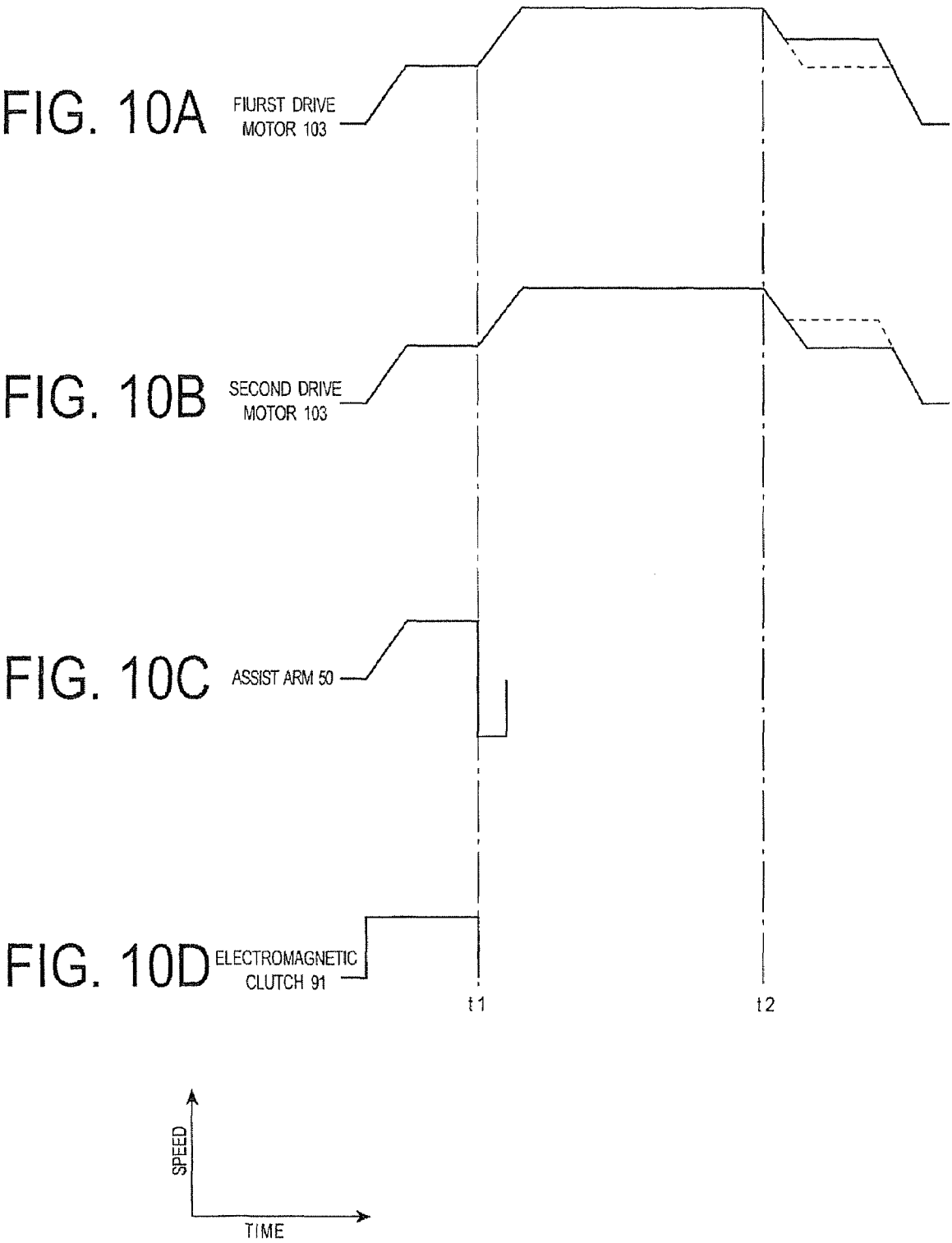
FIGS. 10A to 10D are time charts for explaining the operations of the first and second conveying units relating to the same embodiment.

Namely, as shown in the time chart of FIG. 10B, the rotational speed of second drive motor 83 for driving movement of main arm 85 as time t1 when main arm 85 starts movement in the peripheral direction of pulley Pb on the downstream side from the straight portion of belt 81 as starting point slows as indicated by the solid line. Further, inversely, it is possible to increase the rotational speed of first drive motor 103 for driving conveying roller 102, thereby increase the rotational speed of conveying roller 102 faster than the moving speed of main arm 85 (FIG. 10A).

Further, in the embodiments aforementioned, a case that sheets M composed of copy papers with recorded images formed on are aligned and stapled is explained. However, the present invention is not limited to it and may be applied to an apparatus for aligning other sheets such as postal matter or banknotes. Further, the present invention is not limited straight to the aforementioned embodiments, and at the execution stage, within a range which is not deviated from the objects of the present invention, the components can be modified and materialized, and by appropriate combination of a plurality components disclosed in the embodiments aforementioned, various inventions can be formed.

The sheet processing apparatus of the present invention has the constitution and operation aforementioned, thereby produces effects such as improvement of the conveying reliability and paper receiving alignment.

What is claimed is:

1. A sheet processing apparatus comprising:

a processing tray to load a sheet bundle;

a first conveying unit having a rotary shaft installed at least at an end on a downstream side in a direction to move the sheet bundle on the processing tray and drive to rotate via a first drive source and a drive unit and a roller installed on the rotary shaft to load and convey the sheet bundle and discharge the sheet bundle from the end on the downstream side and from the processing tray;

a second conveying unit having a pair of pulleys having at least one of them installed rotatably on the rotary shaft on the downstream side driven to rotate via a second drive source and a drive unit, a belt stretched over the pair of pulleys, and an arm installed on the belt to hook an end of the sheet bundle on the processing tray, convey the sheet bundle together with the roller, and discharge the sheet bundle from the end on the downstream side and from the processing tray; and a controller to control the second conveying unit to synchronize the speed of the arm when moving along a straight portion of the belt with a rotational speed of the roller of the first conveying unit and change the speed when moving in a peripheral direction of the pulley on the downstream side among the pair of pulleys from the rotational speed of the roller.

2. The apparatus of claim 1, wherein the controller controls the second conveying unit to be slower the speed of the arm when moving in the peripheral direction of the pulley on the downstream side than the rotational speed of the roller.

3. The apparatus of claim 1, wherein the controller controls the first conveying unit to be faster the rotational speed of the roller than the speed when the arm moves in the peripheral direction of the pulley on the downstream side.

4. A sheet processing apparatus comprising:

processing tray means for loading a sheet bundle;

first conveying means having a rotary shaft installed at least at an end on a downstream side in a direction for moving the sheet bundle on the processing tray means and driven to rotate via a first drive source and a drive unit and a roller installed on the rotary shaft for loading and conveying the sheet bundle and discharging the sheet bundle from the end on the downstream side and from the processing tray;

second conveying means having a pair of pulleys having at least one of them installed rotatably on the rotary shaft on the downstream side driven to rotate via a second drive source and a drive unit, a belt stretched over the pair of pulleys, and an arm installed on the belt for hooking an end of the sheet bundle on the processing tray, conveying it together with the roller, and discharging the sheet bundle from the end on the downstream side and from the processing tray; and control means for controlling the second conveying means to synchronize the speed of the arm when moving along a straight portion of the belt with a rotational speed of the roller of the first conveying means and change the speed when moving in a peripheral direction of the pulley on the downstream side among the pair of pulleys from the rotational speed of the roller.

5. The apparatus of claim 4, wherein the control means controls the second conveying means to be slower the speed of the arm when moving in the peripheral direction of the pulley on the downstream side than the rotational speed of the roller.

6. The apparatus of claim 4, wherein the control means controls the first conveying mans to be faster the rotational speed of the roller than the speed when the arm moves in the peripheral direction of the pulley on the downstream side.

* * * * *